US005258701A

United States Patent [19]

Pizzi et al.

[11] Patent Number: 5,258,701

[45] Date of Patent: Nov. 2, 1993

[54] DC POWER SUPPLY

[75] Inventors: Raymond J. Pizzi, Bricktown, N.J.; John M. O'Meara, Morrisville, Pa.

[73] Assignee: The United States of America as represented by the Secretary of the Army, Washington, D.C.

[21] Appl. No.: 939,329

[22] Filed: Sep. 2, 1992

[51] Int. Cl.[5] ..... G05F 1/58

[52] U.S. Cl. ..... 323/269; 323/273; 323/282; 363/124

[58] Field of Search ..... 323/268, 269, 273, 280, 323/281, 282; 363/124

[56] References Cited

U.S. PATENT DOCUMENTS 4,502,152 2/1985 Sinclair ..... 323/268 X

*Primary Examiner*—Emanuel T. Voeltz

*Attorney, Agent, or Firm*—Michael Zelenka; John M. O'Meara

[57] ABSTRACT

Switching and linear voltage regulators operating independently are combined in a power supply system, with their outputs in parallel to sustain a regulated voltage output from that system, while minimizing the physical size and weight thereof.

13 Claims, 2 Drawing Sheets

DC POWER SUPPLY

GOVERNMENT INTEREST

The invention described herein may be manufactured, used, and licensed by or for the United States Government for governmental purposes without the payment to us of any royalties thereon.

BACKGROUND OF THE INVENTION

The present invention relates generally to circuitry for providing a regulated voltage output and more particularly to such circuitry which responds rapidly to sustain the power requirements of a load, while maintaining high efficiency to render the implementation thereof compact in both size and weight.

DC power supply circuitry for directing current to a load at a constant voltage is well known in the electrical arts. As explained in an article entitled POWER SUPPLIES which was published by Power-One, Inc. on pages 160 and 163 in the May 1989 edition of EVALUATION ENGINEERING, linear and switching regulators are the most fundamental forms of such circuitry. The advantages of linear regulators are very low noise and excellent regulation in regard to both line (voltage) and load (current), while the advantages of switching regulators are high efficiency and a very compact nature in regard to both size and weight. For a linear regulator, the advantages are derived from its continuous operation, and for a switching regulator the advantages are derived from its periodic operation. Disadvantages are also inherent to each type of regulator, with greater thermal dissipation causing lower efficiency to result from the continuous operation of linear regulators, while switching noise and slower response result from the periodic operation of switching regulators. For comparable power output therefore, linear regulators are preferred for their electrical operating characteristics but they are much larger in size due to heat sinks for much greater thermal dissipation, while switching regulators are preferred for their much smaller size and weight but their electrical operating characteristics present problems.

Circuitry combining linear and switching (or chopper) regulators for particular applications is well known in the art.

One such combination is found in U.S. Pat. No. 3,600,667 wherein the linear and switching regulators are interconnected with the output of the former being fed back to control the power output time duration of the latter. Another such combination is found in U.S. Pat. No. 4,502,152 wherein the linear and switching regulators operate independently with only their outputs connected in parallel to supply a power output. However, the linear regulator has the higher voltage output and therefore, it alone supplies ripple free power under predefined steady state load conditions, while only the switching regulator supplies power under predefined transient load conditions which result when power demand is increased. Consequently, the power supply concept of this patent is exactly opposite to that of the invention disclosed and claimed herein, as will be clearly understood from the disclosure provided hereinafter.

SUMMARY OF THE INVENTION

It is the general object of the present invention to derive superior line and load regulation with a DC power supply which is compact in both size and weight due to efficient operation.

It is a specific object of the present invention to accomplish the above-stated general object and to also limit the magnitude of ripple in the power supplied.

It is another specific object of the present invention to accomplish the above-stated general object and to also minimize internal loading effects.

It is still another specific object of the present invention to accomplish the above-stated general object and to also optimize regulation response.

These and other objects are accomplished in accordance with the present invention by supplying DC power from independent switching and linear regulators which have their outputs connected in parallel. Due to its compact nature and high efficiency, the switching regulator is designed to supply power continuously during steady state load conditions. The linear regulator is designed to supply power intermittently during transient load conditions because of its low noise and quick response capabilities. Such intermittent operation permits the size of the linear regulator to be minimized and renders the inefficiency thereof less onerous. The output voltage of the linear regulator is set below that of the switching regulator by the permissible variation in the line voltage. When the magnitude of ripple is to be limited, that permissible variation becomes the tolerable ripple magnitude. In some embodiments of the invention, loading effects internal to the switching regulator may be minimized by blocking the backflow of current to the output thereof through at least one diode. Also, output from the linear regulator may be applied through at least one capacitor to optimize the response thereof.

The scope of the present invention is only limited by the appended claims for which support is predicated on the preferred embodiments hereinafter set forth in the following description and the attached drawings.

DESCRIPTION OF THE PREFERRED EMBODIMENTS

Figure 1:
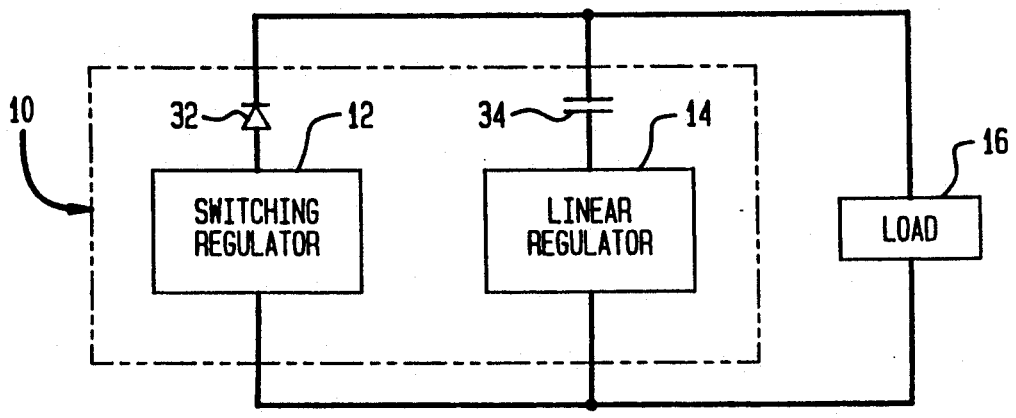
FIG. 1 is a block diagram of the invention wherein independent switching and linear regulators are connected in parallel to supply power.

A DC power supply system 10 in accordance with the invention includes at least one switching regulator 12 and at least one linear regulator 14 as shown in FIG. 1 wherein a dynamic load 16 is connected to receive power therefrom. The regulators 12 and 14 each operate independently and are connected in parallel to sustain a regulated voltage output from the system 10. Each regulator 12 and 14 has an unregulated DC source (shown in FIGS. 2 and 3) applied at the input thereof. The design of the regulators 12 and 14 is coordinated for the system 10 to be of minimal physical size and weight when operating under predefined steady state and transient load conditions. The switching regulator 12 is designed to supply current under steady state load conditions, while the linear regulator 14 is designed to supply current under transient conditions resulting from an increased power demand by the load 16. Although applications are possible wherein a plurality of either or both the switching and linear regulators 12 and 14 would be required, only applications requiring one of each type will be discussed hereinafter. Each of the regulators 12 and 14 is specifically designed for the particular application however, the nature of such design may be conventional to the power supply arts.

Figure 2:
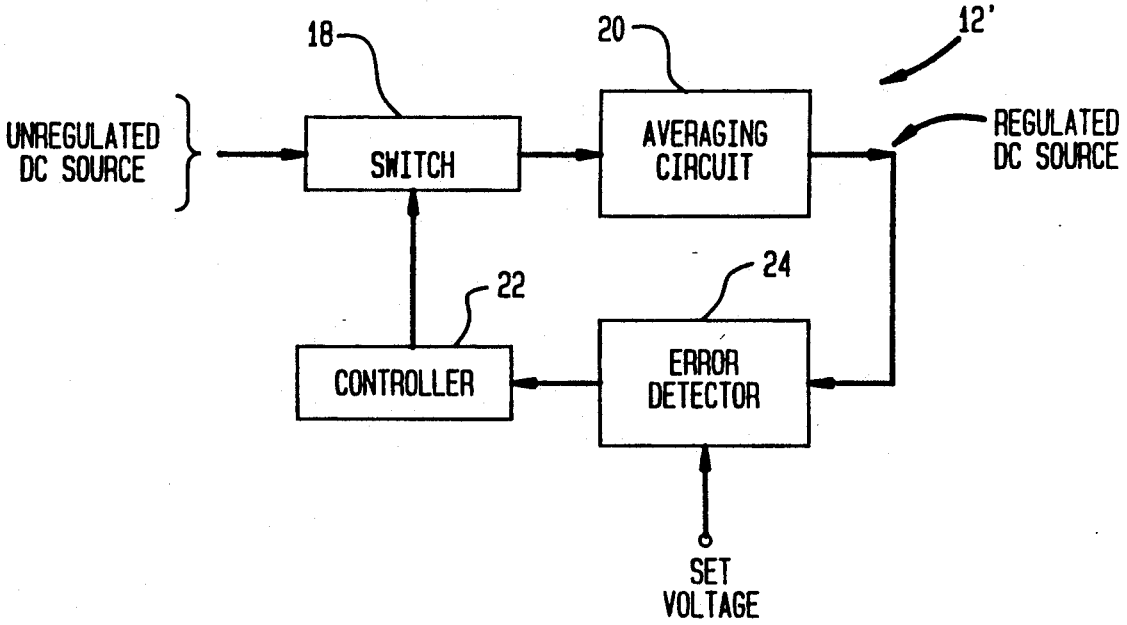
FIG. 2 (PRIOR ART)
FIG. 2 is a block diagram of a typical switching regulator wherein periodic control of a switch determines the power derived therefrom.

As shown in FIG. 2, one switching regulator 12' of conventional design is characterized by a periodic feedback control loop which includes a switch 18, such as a transistor. Of course, those skilled in the art of power regulation will understand without further explanation herein that the switch 18 includes input and output terminals between which electrical conductivity occurs only when a feedback signal is applied to a control terminal thereof. Under operative conditions for the switching regulator feedback arrangement of FIG. 2, an unregulated DC source is applied to the switch input terminal from which current passes to the switch output terminal during the conductive intervals of the switch 18. A circuit means 20 connects to the switch output terminal for averaging the voltage periodically developing thereat and consequently, a regulated DC source of voltage is available from the output terminal. This averaging circuit 20 includes energy storing elements, such as capacitors and/or inductors (not shown) which are connected in accordance with any of several well known arrangements. Signals are applied periodically to the control terminal from a controller 22 which segments time into a continuous sequence of equal duration duty cycles and generates the feedback signal throughout an interval of each duty cycle. The duration of each such interval is determined in accordance with the magnitude of a switch conductivity error signal which a detector 24 applies to the controller 22. Within the detector 24 the switch conductivity error signal is derived in accordance with the instantaneous difference between the regulated voltage output and a set voltage, such as with a differential comparator (not shown).

Figure 3:
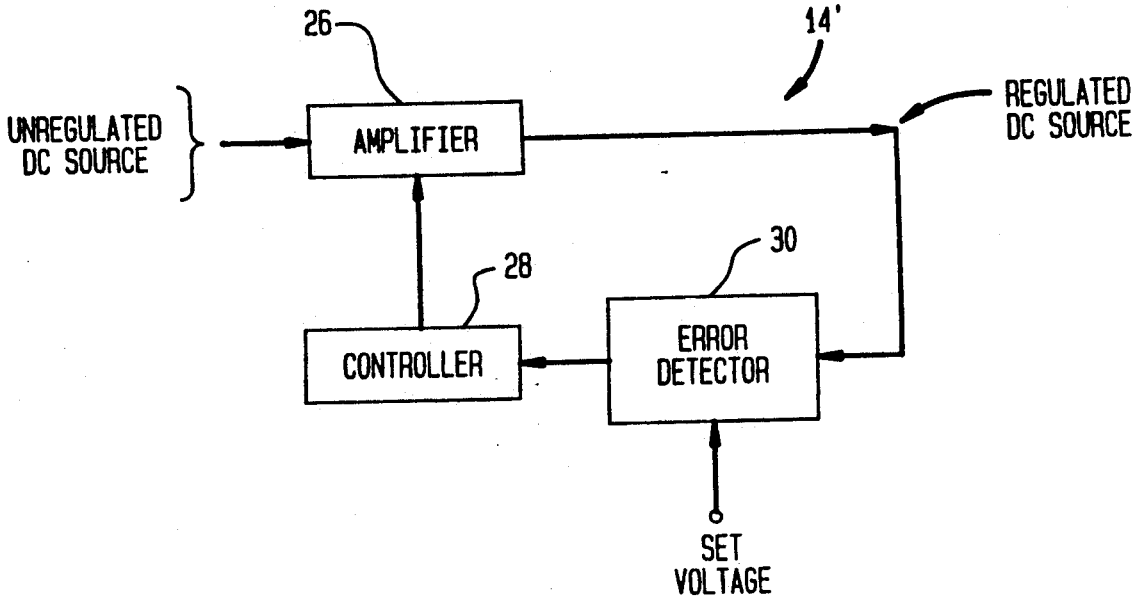
FIG. 3 (PRIOR ART)
FIG. 3 is a block diagram of a typical linear regulator wherein continuous control of a Class A amplifier determines the power derived therefrom.

As shown in FIG. 3, one linear regulator 14' of conventional design is characterized by a continuous feedback control loop which includes a Class A amplifier 26, such as a transistor. Of course, those skilled in the art of power regulation will understand without further explanation herein that the amplifier 26 includes input and output terminals between which current flow is continuously controlled in proportion to the magnitude of a feedback signal applied at a gate terminal thereof. Under operative conditions for the linear regulator feedback arrangement of FIG. 3, an unregulated DC source is applied to the amplifier input terminal from which current passes continuously to sustain a regulated DC source of voltage at the amplifier output terminal. Signals are applied continuously to the control terminal from a controller 28 which varies the amplitude thereof in accordance with the magnitude of an amplifier power transfer error signal. A detector 30 applies the amplifier power transfer error signal to the controller 28. Within the detector 30, the error signal is derived in accordance with the instantaneous difference between the regulated voltage output and a set voltage, such as a differential comparator (not shown).

Of course, some power from the unregulated DC source is dissipated as heat in both the switch 18 of regulator 12' and the amplifier 26 of regulator 14'. Consequently, the switch 18 and amplifier 26 must each be disposed on a heat sink that is sized in accordance with the thermal dissipation to be encountered thereby. For the same power output, the heat sink of the switch 18 encounters less thermal dissipation than does the heat sink of the amplifier 26. This is so because power is only transferred periodically through the switch 18 but is transferred continuously through the amplifier 26. In relative size therefore, the heat sink of the switch 18 is smaller than the heat sink of the amplifier 26 and since such heat sinks are by far the component of greatest size and weight in regulators 12' and 14', regulator 14' is of greater relative size and weight per unit of power than regulator 12'. Furthermore, those skilled in the art of heat sink design will realize without discussion herein that in some embodiments of the invention, a common heat sink with a total thermal capacity for both types of regulators 12' and 14' could be utilized. Other more sophisticated versions of the conventional regulators 12' and 14' are also possible, such as those which include protective circuitry (not shown) that functions to override the controllers 22 and 28 respectively. Furthermore, the unregulated DC source for either of the regulators 12' or 14' can be derived in many well known ways, such as from a solar cell or an AC source that is applied through a transformer and a rectifier (not shown).

In system 10 of the invention, each regulator 12 and 14 is incorporated to complement the physical and functional characteristics of the other, with each being designed to sustain the regulated voltage output thereof under extremely different loading conditions. Because it is more efficient and more compact in size and weight, the switching regulator 12 is designed to supply only the steady state power demands of the load 16. The linear regulator 14 is designed to supply only the transient demands of the load 16 for increased power, because it is substantially noise free and responds more quickly to such surges demands. Generally, the invention is implemented by outputting current at a higher voltage from the switching regulator 12 than from the linear regulator 14, and defining that higher voltage as the steady state regulated voltage output of the system 10. Otherwise, the switching regulator 12 is particularly designed to continuously supply the maximum steady state demand of the load 16, while the linear regulator 14 is particularly designed to intermittently supply the maximum transient surge demand of the load 16. Consequently, so long as the demand of the load 16 remains stable or drops, substantially all current output from system 10 will be supplied by the switching regulator 12. When the power demand of the load 16 suddenly increases or surges however, the regulated voltage output of system 10 is only sustained if an appropriate increase in current can be supplied therefrom. Since the switching regulator 12 responds slowly to supply increased current, it cannot instantaneously supply a significant power increase to the load 16. Consequently, the regulated voltage output of system 10 drops to the lower voltage output of the linear regulator 14 which responds quickly to supply the increased power demand at that voltage for the surge interval. During such surge intervals, the switching regulator 12 recovers and responds thereafter to the increased power demand of the load 16.

The voltage regulation requirements of the particular application to which the load 16 relates will of course determine the permissible output voltage difference between the switching and linear regulators 12 and 14. Furthermore, this voltage difference can also be set to reduce ripple and other noise that inherently exists in the voltage output of the switching regulator 12 and is unacceptable for some applications to which the load 16 could relate. In the invention therefore, the linear regulator 14 is incorporated into system 10 to periodically sustain the regulated voltage output thereof when the switching regulator 12 cannot immediately satisfy the demands of the load 16. The invention can be easily understood by referring to FIG. 4 wherein the regulated voltage output of system 10 is represented by the solid curve which results due to operation of both the switching and linear regulators 12 and 14 respectively, as indicated therein. The dotted curve portions represent the variation that would otherwise be encountered in the regulated voltage output from system 10, due to ripple or increased power demand by the load 16 if such output was sustained only by the switching regulator 12. Therefore, it will be apparent to those skilled in the art of power supply systems that in the invention, the linear regulator 14 operates intermittently to reduce the magnitude of variation encountered in the regulated voltage output of the system 10.

Figure 4:
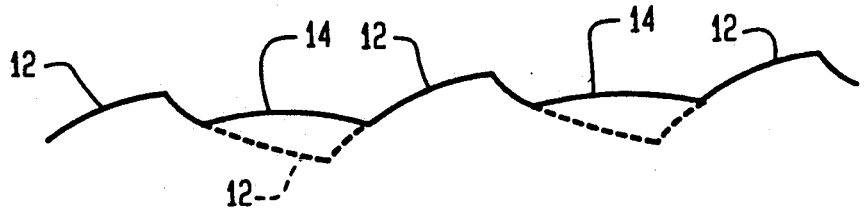
FIG. 4 is a voltage output vs. time plot which relates generally to the power supply system of the invention.

Although FIG. 4 demonstrates how any embodiment of the invention functions to sustain the regulated voltage output of system 10 in the manner described previously, it is particularly appropriate to the reduction of ripple in the voltage output of the switching regulator 12. For such purposes, the dotted curve portions in FIG. 4 represent the bottom troughs of the ripple. As discussed hereinafter, operation of the linear regulator 14 can be predetermined to reduce such ripple by any desired amount, including the substantial elimination thereof. Again of course, the voltage output of the linear regulator 14 is by design of lesser magnitude than that of the switching regulator 12. Therefore, when the regulated voltage output of system 10 is a maximum, current is only supplied to the load 16 from the switching regulator 12, because only it is designed to operate having that voltage output. Due to the ripple, however, the voltage output of the switching regulator 12 periodically drops below that of the linear regulator 14 which starts supplying current to the load 16 as soon as its voltage output level is reached. During the time the voltage output of the switching regulator 12 is below that of the linear regulator 14, current is only supplied to the load 16 by the linear regulator 14 because it then has the higher output voltage. Of course, the switching regulator 12 starts supplying current to the load 16 again when its voltage output rises to and above that of the linear regulator 14.

Of course, the voltage output difference between the regulators 12 and 14 respectively, is not the only design consideration to be addressed. For example, whenever the voltage output of the switching regulator 12 falls below that of the linear regulator 14, the averaging circuit 20 in the switching regulator 12 will demand current from the regulated voltage output of system 10, which effectively adds to the current demand of the load 16. To avoid such internal loading effects, current supplied from the switching regulator 12 may be directed through a diode 32 which blocks the backflow of current thereto when the linear regulator 14 sustains the demands made by the load 16 on system 10. Then current supplied by the linear regulator 14 will be directed only to the load 16, so that the physical size and response time of the power supply system 10 can be optimized. For current to pass from the switching regulator 12 however, diode 32 must be forward biased to overcome a voltage drop thereacross. Of course, the power dissipation resulting from this voltage drop must be included as a design consideration for the power supply system 10. Furthermore, current supplied from the linear regulator 14 could be applied through a capacitor 34 to enhance its response when sustaining the demands made by the load 16 on the power supply system 10. However, the magnitude of that current is limited by the size of the capacitor 34 and significant time constants or loading effects could be encountered as the size thereof increases. Consequently, the diode 32 and capacitor 34 should only be incorporated into the power supply system 10 after full consideration is given to the overall effect thereof.

Of course, the operating parameters of both the switching and linear regulators 12 and 14 are a matter of design. However, due to its substantially lower efficiency and greater size relative to the switching regulator 12, design of the linear regulator 14 is more critical. Therefore, the switching regulator 12 would usually be designed first, to supply the maximum steady state demand of the load 16 and then the linear regulator 14 would be designed to supply the maximum transient surge demand thereof, for which the switching regulator 12 is unable to immediately respond.

Those skilled in the electronic arts will appreciate without any further explanation that within the concept of this invention, many modifications and variations are possible to the above disclosed embodiments of the DC power supply system 10. Consequently, it should be understood that all such modifications and variations fall within the scope of the following claims.

What is claimed is:

1. In a power supply of the type which applies a regulated voltage output, the improvement comprising:

a switching regulator; and a linear regulator;

said switching and linear regulators each operating independently and having the outputs thereof connected in parallel to sustain the regulated voltage output, with the design of said regulators coordinated to provide a higher voltage output from said switching regulator than from said linear regulator so that power is supplied from said switching regulator for predefined steady state load conditions and from said linear regulator for predefined transient surge load conditions, whereby the physical size and weight of the power supply is minimized.

2. The power supply of claim 1 wherein the voltage output difference between said regulators is coordinated to reduce ripple in the regulated voltage output.

3. The power supply of claim 1 wherein the backflow of current to the output of said switching regulator is blocked with a diode to preclude loading effects therefrom within the power supply.

4. The power supply of claim 1 wherein output from said linear regulator passes through a capacitor to enhance the response thereof when current is demanded therefrom to sustain the regulated voltage output.

5. The power supply of claim 1 wherein said switching regulator is a periodic control loop which includes:

a switch having an input terminal and an output terminal between which electrical conductivity occurs when a feedback signal is applied to a control terminal thereof, and an unregulated DC source is applied at said input terminal;

circuit means connected to said output terminal for averaging the voltage periodically developed thereat to derive a regulated DC source of voltage at said output terminal;

a switch controller for segmenting time into a continuous sequence of equal duration duty cycles and for generating the feedback signal throughout an interval of each duty cycle, with the duration of each such interval being determined according to the magnitude of a switch conductivity error signal; and a detector for deriving the switch conductivity error signal in accordance with the instantaneous difference between the regulated voltage output and a set voltage.

6. The power supply of claim 1 wherein said linear regulator is a continuous control loop which includes;

a Class A amplifier having an input terminal and an output terminal between which current flow is continuously controlled in proportion to the magnitude of a feedback signal applied at a gate terminal thereof to derive a regulated DC source of voltage at said output terminal from an unregulated DC source applied at said input terminal;

an amplifier controller for continuously generating the feedback signal in accordance with the magnitude of an amplifier power transfer error signal; and a detector for deriving the amplifier power transfer error signal in accordance with the instantaneous difference between the regulated voltage output and a set voltage.

7. The power supply of claim 6 wherein said switching regulator is a periodic control loop which includes:

a switch having an input terminal and an output terminal between which electrical conductivity occurs when a feedback signal is applied to a control terminal thereof, and an unregulated DC source is applied at said input terminal;

circuit means connected to said output terminal for averaging the voltage periodically developed thereat to derive a regulated DC source of voltage at said output terminal;

a switch controller for segmenting time into a continuous sequence of equal duration duty cycles and for generating the feedback signal throughout an interval of each duty cycle, with the duration of each such interval being determined according to the magnitude of a switch conductivity error signal; and a detector for deriving the switch conductivity error signal in accordance with the instantaneous difference between the regulated voltage output and a set voltage.

8. The power supply of claim 7 wherein the voltage output difference between said control loops is coordinated to reduce ripple in the regulated voltage output.

9. The power supply of claim 7 wherein the backflow of current to the output of said periodic control loop is blocked with a diode to preclude loading effects therefrom within the power supply.

10. The power supply of claim 7 wherein output from said continuous control loop passes through a capacitor to enhance the response thereof when current is demanded therefrom to sustain the regulated voltage output.

11. The power supply of claim 6 wherein the output voltage difference between said switching regulator, and said continuous control loop is coordinated to reduce ripple in the regulated voltage output.

12. The power supply of claim 6 wherein the backflow of current to the output of said switching regulator is blocked with a diode to preclude loading effects therefrom within the power supply.

13. The power supply of claim 6 wherein output from said continuous control loop passes through a capacitor to enhance the response thereof when current is demanded therefrom to sustain the regulated voltage output.

* * * * *